US006475125B1

(12) United States Patent
Roberts

(10) Patent No.: US 6,475,125 B1
(45) Date of Patent: Nov. 5, 2002

(54) HARNESS FOR PERFORMING AEROBIC EXERCISES ON A THERAPEUTIC BALL

(76) Inventor: Steven D. Roberts, 1267 Smokey Row La., Carmel, IN (US) 46033

( * ) Notice: Subject to any disclaimer, the term of this patent is extended or adjusted under 35 U.S.C. 154(b) by 0 days.

(21) Appl. No.: 09/819,528

(22) Filed: Mar. 28, 2001

(51) Int. Cl.[7] ..... A63B 21/02

(52) U.S. Cl. ..... 482/123; 482/121; 482/77; 482/124

(58) Field of Search ..... 482/123, 148, 482/907, 121, 126; 473/26; 602/4; 128/875, 876

(56) References Cited

U.S. PATENT DOCUMENTS

| | | | | |
|---|---|---|---|---|
| 3,351,343 A | | 11/1967 | Papp | |
| 3,709,491 A | * | 1/1973 | Minchin | 473/26 |
| 3,918,618 A | * | 11/1975 | Castaneda | |
| 4,147,353 A | | 4/1979 | Moore | |
| 4,247,117 A | * | 1/1981 | Reichert | |
| 4,592,549 A | | 6/1986 | Ryan | |
| 5,236,411 A | * | 8/1993 | Backman | |
| 5,713,803 A | * | 2/1998 | Scher et al. | 473/26 |
| 5,810,700 A | | 9/1998 | Orcutt | |
| 6,024,657 A | | 2/2000 | Bettencourt, Jr. | |

* cited by examiner

*Primary Examiner*—Jerome W. Donnelly
(74) *Attorney, Agent, or Firm*—Maginot, Moore & Bowman, LLP

(57) ABSTRACT

A harness for an ABS therapeutic ball allows a user to perform aerobic exercises while seated on the ABS therapeutic ball. The harness includes a stabilizer portion having circumferential straps extending therefrom. A handle is positioned between the circumferential straps proximate a joining area thereof. An adjustment strap having a self fastening system also extends from the stabilizer portion of the harness and interacts with the joining area of the circumferential straps to provide a single, overall size adjustment of the harness to accommodate various sizes of ABS therapeutic balls. Once installed onto an ABS therapeutic ball, the user may perform various aerobic exercises while seated on the ABS therapeutic ball and firmly grasping the handle of the harness. The harness thus provides a secure, no-slip, and stable platform for aerobically exercising on the ABS therapeutic ball.

17 Claims, 2 Drawing Sheets

HARNESS FOR PERFORMING AEROBIC EXERCISES ON A THERAPEUTIC BALL

FIELD OF THE INVENTION

The present invention relates generally to exercise devices and, more particularly, to a harness for a therapeutic ball.

DESCRIPTION OF THE PRIOR ART

Various elastomeric balls have been developed that allow a child or one of small weight to ride thereon. These balls, however, have traditionally not been able to support too much weight, especially when under stress or compression. Variations of these balls have been used as exercise balls commonly referred to as "swiss balls" or "therapeutic balls". Such past therapeutic balls would explode or rapidly deflate (similar to a balloon) if punctured while under load (i.e. sitting on it). This made using such therapeutic balls for weight lifting or doing advanced exercises fairly dangerous.

With recent developments in synthetic materials, however, it is now possible to provide an exercise or therapeutic ball that can withstand much greater loads, both static and dynamic. Therapeutic balls made with today's synthetic materials may be termed anti-burst system (ABS) balls. These ABS balls can be loaded with over one thousand pounds with a total weight load capability in excess of over two thousand five hundred pounds. With this capacity for static and dynamic load strengths, such therapeutic balls can now be used for a variety of exercises. In particular, ABS therapeutic balls can and are used by leading athletes to weight train (lifting several hundred pounds or more) while seated or lying upon an ABS therapeutic ball. With such new ABS therapeutic balls, athletes have the comfort of knowing that the ABS therapeutic ball will not explode while it is in use.

While these new ABS therapeutic balls may be used for various static exercises, such ABS therapeutic balls are not useful as an aerobic device (i.e. for aerobic or dynamic exercises). Because ABS therapeutic balls can now handle static and dynamic loads of several thousand pounds or more, such ABS therapeutic balls would lend themselves to various types of aerobic exercises (i.e. dynamic loading). There is currently not, however, a manner in which to use an ABS therapeutic ball for aerobic exercises.

It would thus be desirable to utilize an ABS therapeutic ball for aerobic exercises.

SUMMARY OF THE INVENTION

The present invention is a harness for a therapeutic ball. In particular, the present invention is a harness for a therapeutic ball that allows the therapeutic ball to be used for aerobic exercises. More particularly, the present invention is a harness for a therapeutic ball having a stabilizer portion, an integral handle, and an adjustment strap that allows a user to securely maintain a hold onto the therapeutic ball, especially when seated thereon. The stabilizer portion, integral handle, and adjustment strap provide a positive, secure, and stable platform around the ABS therapeutic ball.

In one form, the present invention is a harness for a therapeutic ball. The harness includes a stabilizer, a first retaining strap extending from the stabilizer, a second retaining strap extending from the stabilizer with the second retaining strap coupled to the first retaining strap remote from the stabilizer, a handle disposed between the first retaining strap and the second retaining strap, and an adjustment strap extending from the stabilizer and cooperating with the first and second retaining straps, wherein the adjustment strap is operative to provide a single adjustment for changing the size of the harness.

In another form, the present invention is a harness for an ABS therapeutic ball. The harness includes a stabilizing strap portion, a first circumferential strap coupled to and extending from the stabilizing strap portion, and a second circumferential strap coupled to and extending from the stabilizing strap portion. The first circumferential strap and said second circumferential strap are coupled at a terminating point of each of the first and second circumferential straps. The harness further includes a handle formed of a strap portion coupled at one end thereof to the first circumferential strap proximate the terminating point thereof and at another end thereof to the second circumferential strap proximate the terminating point thereof, and an adjustment strap coupled to and extending from the stabilizing strap portion and having a self fastener. The adjustment strap is adapted to loop around the terminating points and attach to itself via the self-fastener such that the harness is size adjustable to accommodate various sizes of ABS therapeutic balls.

In yet another form, the present invention is a harness for an ABS therapeutic ball. The harness includes a triangular stabilizer of nylon strapping defining a first coupling point, a second coupling point, and a third coupling point. A first nylon circumferential strap having first and second ends is attached at the first end to the first coupling point of the triangular stabilizer. A second nylon circumferential strap having first and second ends is attached at the first end to the second coupling point of the triangular stabilizer. The second end of the first nylon circumferential strap is attached to the second end of the second nylon circumferential strap. A handle of nylon strapping having a first end is attached to the first nylon circumferential strap proximate the second end of the first nylon circumferential strap. The handle has a second end that is attached to the second nylon circumferential strap proximate the second end of the second nylon circumferential strap. An adjustment strap is provided having first and second ends with the first end attached to the third coupling point of the triangular stabilizer and adapted to extend about the attachment point of the first and second nylon circumferential straps under the handle. The harness further includes means for fastening the adjustment strap onto itself wherein the adjustment strap is operative to be attached to itself in a plurality of positions defining a plurality of lengths of the adjustment strap to accommodate a plurality of sizes of therapeutic balls by adjusting the size of the harness. Further, when the harness is mounted onto the ABS therapeutic ball the stabilizer is substantially diametrically opposite the handle.

The present invention makes it possible for an ABS therapeutic ball to be used as an aerobic exerciser and/or for aerobic exercises. In particular, with the present harness in place on an ABS therapeutic ball, a user sitting on the ABS therapeutic ball grasps the integral handle of the harness that is between the user's legs. Once the handle is grasped, the user sitting on the ABS therapeutic ball can begin to bound by starting a hopping motion, thus initiating an aerobic exercise. Such motion can be slow and controlled or very aggressive. This allows the user to exercise aerobically to the user's ability. The present invention thus allows an ABS therapeutic ball to be used with a variety of aerobic exercises.

The present harness is also easily adjustable without losing its holding ability, in order to be used with a variety of sizes of ABS therapeutic balls. The integral handle also aids in the utilization of an ABS therapeutic ball by elderly or neurologically impaired individuals. The integral handle provides added stability for a user.

It is thus an object of the present invention to allow an ABS therapeutic ball to be used for aerobic exercises.

It is another object of the present invention to provide a stable means for holding onto an ABS therapeutic ball during an aerobic exercise.

It is yet another object of the present invention to provide a means for holding onto an ABS therapeutic ball during aerobic exercising that is adaptable to a variety of sizes of ABS therapeutic balls.

It is a further object of the present invention to provide an adjustable holding device for an ABS therapeutic ball, especially for use during an aerobic exercise that does not compromise its retention ability when used on various sizes of ABS therapeutic balls.

BRIEF DESCRIPTION OF THE DRAWINGS

The above-mentioned and other features and advantages of this invention, and the manner of attaining them, will become more apparent and the invention will be better understood by reference to the following descriptions of embodiments of the invention taken in conjunction with the accompanying drawings, wherein.

Corresponding reference characters indicate corresponding parts throughout the several views.

DETAILED DESCRIPTION

While the invention is susceptible to various modifications and alternative forms, the specific embodiment(s) shown and/or described herein is by way of example. It should thus be appreciated that there is no intent to limit the invention to the particular form disclosed, as the intention is to cover all modifications, equivalents, and alternatives falling within the spirit and scope of the invention as defined by the appended claims.

Figure 1:
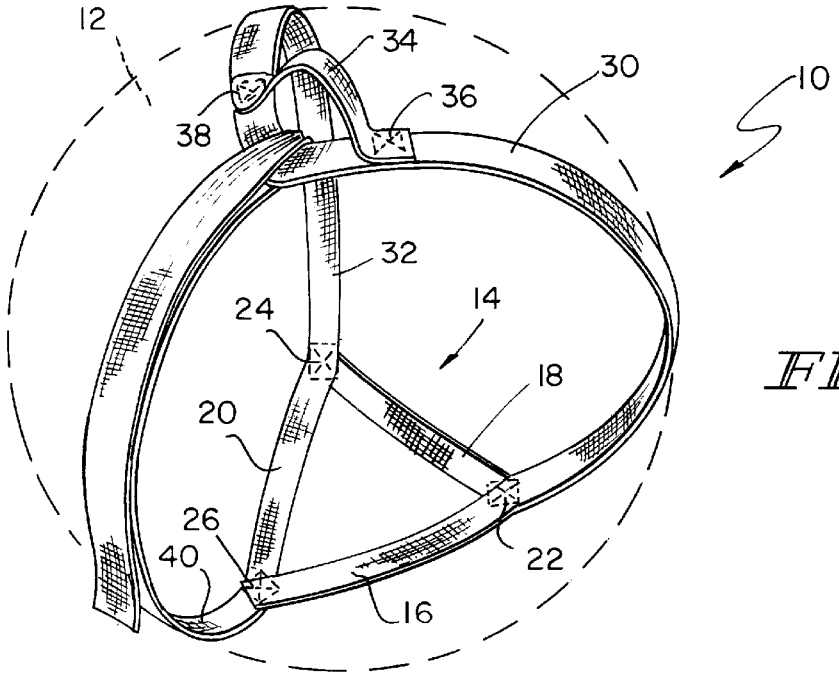
FIG. 1 is a perspective view of a harness made in accordance with the principles presented herein installed on a ball that is depicted in phantom.
Figure 2:
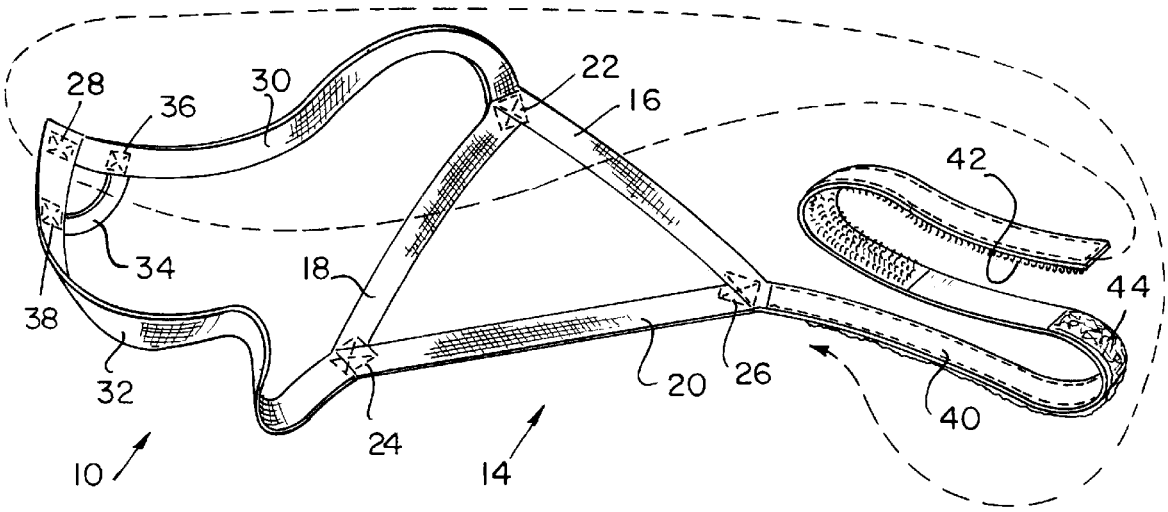
FIG. 2 is a perspective view of the harness of FIG. 1 in a dissembled state or not installed on a ball.

Referring to FIGS. 1 and 2 there is shown an exemplary harness, generally designated 10, that are made in accordance with the principles presented herein. The harness 10 is adapted to be secured about a ball 12 (shown in phantom in FIG. 1), especially an ABS therapeutic ball such as those discussed above. The harness 10 is adjustable as described herein such that the size or diameter of the ball 12 is of no consequence. The harness 10 is made of a suitable, high-strength strapping such as nylon or the like that provides little to no stretching. The terms strap and strapping as used herein encompass bands, strops, belts, tapes, ribbons and/or the like that is sufficiently wide, as compared to rope or chording so as to provide a fair amount of width contact with the ball 12 per the length of the strap or strapping. Straps, as compared to rope or chording, tend to not arcuately shift about the ball 12 (i.e. move about the circumference of the ball) during use.

The harness 10 includes a stabilizer portion 14 here shown as triangular in shape. While other shapes of a stabilizer may be utilized, a triangular shape has been found by the inventor to be a preferred design. A triangular stabilizer aids in preventing the various straps of the harness from shifting circumferentially during use. The triangular stabilizer also reduces the number of straps necessary for a stable and secure fit.

The triangular stabilizer 14 is formed by a first stabilizer strap 16, a second stabilizer strap 18, and a third stabilizer strap 20. Of course, other stabilizer shapes would be formed by an appropriate number of straps. One end of the strap 16 is attached at a coupling 22 to one end of the strap 18. The coupling 22 is preferably suitable stitching or the like adequate in strength to bind the straps 16 and 18 together and hold them together during twisting and pulling thereof during use. Such stitching may be a suitable nylon thread or the like. Of course, other means for providing a coupling may be used suitable for the intended application as described herein. It should be appreciated that the term stitching as used herein and henceforth, should be construed to include the mentioned variations unless otherwise indicated. The other end of the strap 16 is attached at a coupling 26 to one end of the strap 20. Again, the coupling 26 is preferably suitable stitching or the like. The remaining or other end of the strap 18 is attached at a coupling 22 to the remaining or other end of the strap 16. Again, the coupling 22 is preferably suitable stitching or the like.

Attached to the coupling 22 is one end of a circumference strap 30, while attached to the coupling 24 is one end of another circumference strap 32. The other ends of the circumference straps 30 and 32 are attached at a coupling 28 (see FIG. 2). The coupling 28 is preferably suitable stitching or the like in the same manner as the couplings 22, 24, and 26. The circumference straps 30 and 32 form a closed loop. Disposed between the circumference straps 30 and 32 proximate the coupling 28 is a handle 34. The handle 34 is preferably made of a strap of the same material as the stabilizer portion 14 and the circumference straps 30 and 32. The handle 34 has one end that is attached at a coupling 36 to the circumference strap 30, preferably by stitching or the like, while another end of the handle 34 is attached at a coupling 38 to the circumference strap 32, again, preferably by stitching or the like. The handle 34 is formed with enough strap length so as to form a grasping area between the handle 34 and the circumference straps 30 and 32 that can accommodate a user's hand or hands.

Attached to the coupling 26 of the stabilizer portion 14 is a harness adjustment strap 40. The adjustment strap 40 is of a length suitable to extend to the coupling 28 or underneath the handle 34 and double back onto itself. As best seen in FIG. 2, the adjustment strap 40 has a suitable fastening system, here characteristic hooks 42 and fuzz 44 of Velcro® on one side thereof. Other suitable types of fasteners may be used, however, the extensions of hooks 42 and fuzz 44 provide easy and relatively secure length adjustment of the adjustment strap 40/harness 10. The adjustment strap 40 is adapted to extend or loop around the coupling 28 and fasten onto itself. Change in where the adjustment strap 40 is secured onto itself provides a change in the size of the harness 10, which translates to a change in the size of therapeutic ball that the harness can accommodate. The adjustment strap 40 thus provides a single means for adjusting the harness 10 to accommodate various sizes of therapeutic balls. Of course, the harness 10 itself may come in various sizes, and thus the adjustment strap 40 would provide a range of adjustments for the particular size of harness 10. In this case, the stabilizer portion 14 would be appropriately scaled as well as the circumference straps 30 and 32, and the adjustment strap 40.

Figure 3:
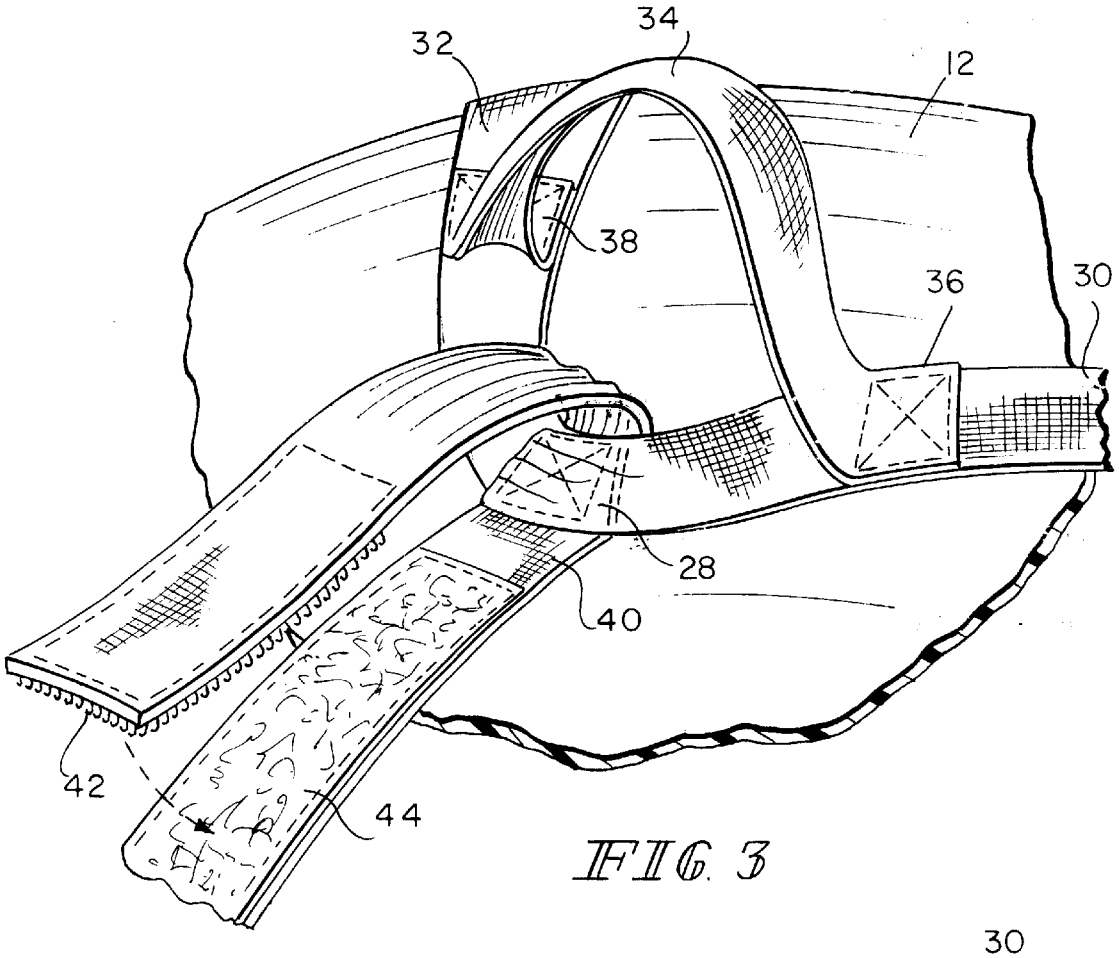
FIG. 3 is an enlarged perspective view of a handle portion of the harness of FIGS. 1 and 2 as it rests upon the ball.
Figure 4:
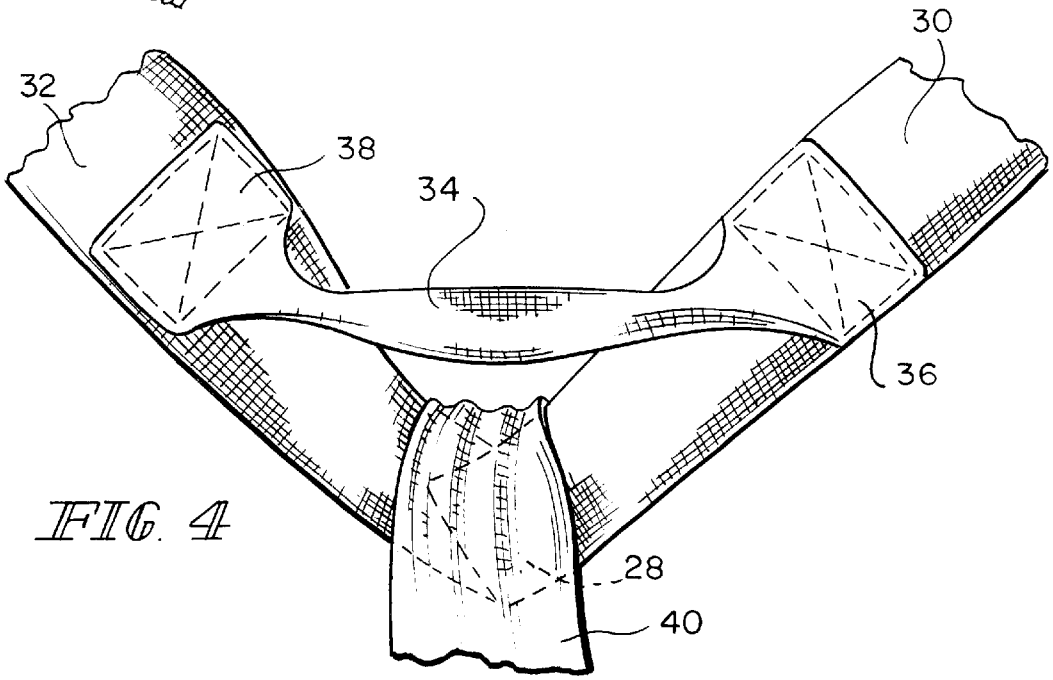
FIG. 4 is an enlarged perspective view of the handle portion of the harness of FIGS. 1 and 2 without the ball.

Referring to FIGS. 3 and 4, there is depicted an enlarged view of the handle 34 and surrounding portions of the harness 10. In particular, FIG. 3 depicts the manner in which the adjustment strap 40 loops around the coupling 28 joining ends of the circumference straps 30 and 32. The coupling 28, in addition to attaching the circumference straps 30 and 32, provides a reinforcement area or portion for the adjustment strap 40. The adjustment strap 40 allows the harness 10 to be cinched tightly against the therapeutic ball 12, with the hooks 42 mating with the fuzz 44 of the Velcro® fastening system.

As best shown in FIG. 4, the handle 34 provides a large loop about which a user's hand or hands can grasp. Even in a flatter position as depicted in FIG. 4 (the area of which changes due to adjustment of the harness 10 onto a ball 12), the handle 34 provides an adequate area about which a user's hand or hands may comfortably grasp the handle 34.

When the harness 10 is installed onto the therapeutic ball 12, a user can sit on the therapeutic ball 12, grasp the handle 34 and perform various maneuvers, particularly aerobic maneuvers such as bounding, aggressive rocking, a combination of bounding and rocking, and many other variations, limited only by the imagination.

While this invention has been described as having a preferred design and/or configuration, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the claims.

What is claimed is:

1. A harness for a therapeutic ball comprising:

a stabilizer;

a first retaining strap extending from said stabilizer;

a second retaining strap extending from said stabilizer, said second retaining strap coupled to said first retaining strap remote from said stabilizer;

a handle disposed between said first retaining strap and said second retaining strap; and an adjustment strap extending from said stabilizer and cooperating with said first and second retaining straps wherein said adjustment strap is operative to provide a single adjustment for changing the size of the harness.

2. The harness of claim 1, wherein said adjustment strap is adapted to extend about said first and second retaining straps when installed on the therapeutic ball, and said adjustment strap includes a self fastener operative to retain said adjustment strap onto itself while extended about said first and second retaining straps.

3. The harness of claim 1, wherein said stabilizer comprises a triangle of straps.

4. The harness of claim 3, wherein said first retaining strap extends from a first apex of said triangle of straps, said second retaining strap extends from a second apex of said triangle of straps, and said adjustment strap extends from a third apex of said triangle of straps.

5. The harness of claim 1, wherein said self-fastener comprises Velcro®.

6. The harness of claim 1, wherein said straps are nylon and said couplings are formed by nylon stitching.

7. The harness of claim 1, wherein said adjustment strap is operative to be attached to itself via said self fastener in a plurality of positions defining a plurality of lengths of said adjustment strap to accommodate a plurality of sizes of therapeutic balls by adjusting the size of the harness.

8. A harness for an ABS therapeutic ball comprising:

a stabilizing strap portion;

a first circumferential strap coupled to and extending from said stabilizing strap portion;

a second circumferential strap coupled to and extending from said stabilizing strap portion;

said first circumferential strap and said second circumferential strap coupled at a terminating point of each of said first and second circumferential straps;

a handle formed of a strap portion coupled at one end thereof to said first circumferential strap proximate said terminating point thereof and at another end thereof to said second circumferential strap proximate said terminating point thereof; and an adjustment strap coupled to and extending from said stabilizing strap portion and having a self fastener, said adjustment strap adapted to loop around said terminating points and attach to itself via said self fastener such that the harness is size adjustable to accommodate various sizes of ABS therapeutic balls.

9. The harness of claim 8, wherein said self-fastener comprises Velcro®.

10. The harness of claim 8, wherein said straps are made of nylon.

11. The harness of claim 8, wherein said stabilizer portion forms a triangle.

12. The harness of claim 11, wherein said triangular stabilizer portion defines a first apex, a second apex, and a third apex; and wherein said first circumferential strap extends from said first apex, said second circumferential strap extends from said second apex, and said adjustment strap extends from said third apex.

13. The harness of claim 12, wherein said straps are coupled via nylon stitching.

14. The harness of claim 8, wherein said adjustment strap is operative to be attached to itself via said self fastener in a plurality of positions defining a plurality of lengths of said adjustment strap to accommodate a plurality of sizes of therapeutic balls by adjusting the size of the harness.

15. A harness for an ABS therapeutic ball comprising:

a triangular stabilizer of nylon strapping defining a first coupling point, a second coupling point, and a third coupling point;

a first nylon circumferential strap having first and second ends with said first end attached to said first coupling point of said triangular stabilizer;

a second nylon circumferential strap having first and second ends with said first end attached to said second coupling point of said triangular stabilizer;

said second end of said first nylon circumferential strap attached to said second end of said second nylon circumferential strap;

a handle of nylon strapping having a first end attached to said first nylon circumferential strap proximate said second end of said first nylon circumferential strap, and a second end attached to said second nylon circumferential strap proximate said second end of said second nylon circumferential strap;

an adjustment strap having first and second ends, said first end attached to said third coupling point of said triangular stabilizer and adapted to extend about said attachment point of said first and second nylon circumferential straps under said handle; and means for fastening said adjustment strap onto itself wherein said adjustment strap is operative to be attached to itself in a plurality of positions defining a plurality of lengths of said adjustment strap to accommodate a plurality of sizes of therapeutic balls by adjusting the size of the harness; and wherein when the harness is mounted onto the ABS therapeutic ball said stabilizer is substantially diametrically opposite said handle.

16. The harness of claim 15, wherein said means for fastening is Velcro®.

17. The harness of claim 15, wherein said attachments are nylon stitching.

* * * * *